US007798222B2

(12) United States Patent
Wilson

(10) Patent No.: US 7,798,222 B2
(45) Date of Patent: Sep. 21, 2010

(54) EXPANDABLE FLUID CEMENT SAND CONTROL

(75) Inventor: Dennis R. Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 481 days.

(21) Appl. No.: 11/555,504

(22) Filed: Nov. 1, 2006

(65) Prior Publication Data

US 2008/0099200 A1 May 1, 2008

(51) Int. Cl.
*E21B 43/02* (2006.01)
*E21B 33/138* (2006.01)

(52) U.S. Cl. ..... 166/276; 166/279; 166/288; 166/300

(58) Field of Classification Search ..... None
See application file for complete search history.

(56) References Cited

U.S. PATENT DOCUMENTS 3,885,629 A * 5/1975 Erb ..... 166/302
3,948,672 A 4/1976 Harnsberger
5,339,902 A 8/1994 Harris et al.
5,582,251 A * 12/1996 Bailey et al. ..... 166/286
6,202,751 B1 3/2001 Chatterji et al.
6,213,209 B1 4/2001 Nguyen et al.
6,446,726 B1 9/2002 Grundmann
6,899,177 B2 5/2005 Chatterj et al.
7,040,405 B2 5/2006 Nguyen et al.
2008/0149337 A1 * 6/2008 Kulakofsky et al. ..... 166/292

FOREIGN PATENT DOCUMENTS

WO WO 01/87797 11/2001
WO WO 2005/110942 11/2005

* cited by examiner

*Primary Examiner*—Zakiya W. Bates

(57) ABSTRACT

A system for preventing the migration of unconsolidated and/or loosely consolidated material into a wellbore. Such prevention is accomplished by introducing a well treatment medium comprising an expandable fluid and a bonding agent into an unconsolidated zone proximate the wellbore. The expandable fluid is allowed to expand and flow through the unconsolidated zone while the bonding agent cures, thereby forming a consolidated zone having sufficient porosity to allow fluid flow therethrough.

31 Claims, No Drawings

EXPANDABLE FLUID CEMENT SAND CONTROL

BACKGROUND OF THE INVENTION

1. Field of the Invention

The present invention relates generally to compositions and methods for treating loosely consolidated and/or unconsolidated subterranean formations. In another aspect, the present invention relates to consolidating loosely consolidated and/or unconsolidated subterranean formations proximate a wellbore while maintaining at least part of the permeability of the formation.

2. Description of the Prior Art

Oil and gas producing wells are often completed in loosely consolidated and/or unconsolidated subterranean production formations which often cause sand or other incompetent formation material to flow into a wellbore along with production fluids. The production of such sand or incompetent formation material along with production fluids tends to cause erosion and/or plugging of production equipment, substantially increasing the costs of well operation.

The use of gravel packs is a known method in the art for preventing the migration of incompetent formation material into a wellbore during the production of fluids from a subterranean formation. In gravel packing operations, a pack of gravel is typically placed in the annulus between a perforated or slotted casing or screen and the walls of the wellbore in the producing interval. The resulting structure provides a barrier to migrating sand or incompetent formation material from the producing formation while allowing the flow of production fluids into the wellbore. However, while gravel packs successfully prevent the production of incompetent formation material with formation fluids, they often fail and require replacement, due to, for example, the deterioration of the casing or screen as a result of corrosion, plugging, and the like. The initial placement of gravel packs adds considerable costs to the completion of a well, and replacement of such gravel packs after completion is even more costly.

Another method of preventing the migration of incompetent formation material known in the art is the use of cement to consolidate, or at least partially consolidate, sand or other incompetent formation material in a subterranean production formation proximate the wellbore. One of the concerns in using such a method is maintaining the permeability of the formation proximate the wellbore, so as to allow the continued production of formation fluids, while at the same time preventing the migration of sand or incompetent formation material into the wellbore. To meet this concern, one type of method involves the use of foamed cements, whereby a foamed cement composition is produced at surface level. Such a composition usually comprises cement, water, and a gas, typically nitrogen or air. The foamed cement is usually then sent down the wellbore and allowed to set near the production formation.

However, there still remains a need for improved methods and compositions for consolidating, or at least partially consolidating, unconsolidated production formations to prevent the migration of sand and other incompetent formation material along with production fluids from a production formation while at the same time maintaining permeability in the production zone.

SUMMARY OF THE INVENTION

In one embodiment of the present invention, there is provided a method comprising: (a) flowing a well treatment medium downwardly through a wellbore to a desired depth, wherein the treatment medium comprises a bonding agent and an expandable fluid, wherein the expandable fluid has a first density at the desired depth; and (b) expanding the expandable fluid to a second density at the desired depth, wherein the second density is at least about 10 percent less than said first density.

In another embodiment of the present invention, there is provided a method comprising: (a) introducing a treatment medium into a wellbore proximate the top of the wellbore, wherein the treatment medium comprises cement, water, and carbon dioxide, wherein the carbon dioxide is in a liquid state when introduced into the wellbore; (b) allowing the treatment medium to flow down through the wellbore while maintaining the carbon dioxide in a liquid and/or supercritical state; (c) introducing at least a portion of the treatment medium into an unconsolidated zone of a subterranean formation; (d) while the treatment medium is in the unconsolidated zone, causing at least a portion of the carbon dioxide to change from a liquid and/or supercritical state to a gaseous state, thereby expanding the carbon dioxide and causing the carbon dioxide to move through at least a portion of the unconsolidated zone; and (e) allowing the cement to cure in the unconsolidated zone to thereby convert the unconsolidated zone into a consolidated zone.

In yet another embodiment of the present invention, there is provided a treatment medium comprising: an expandable fluid, cement, and water. The expandable fluid has a density at 150° F. and 2,000 pounds per square inch absolute that is at least about 20 percent less than the density of the expandable fluid at 50° F. and 2,000 psia.

DETAILED DESCRIPTION

In accordance with one embodiment of the present invention, an underground unconsolidated zone can be treated with a well treatment medium, generally comprising an expandable fluid and a bonding agent. The well treatment medium can be pumped or allowed to flow down a wellbore and introduced into the unconsolidated zone. After introduction into the unconsolidated zone, the bonding agent of the well treatment medium can be allowed to cure, thereby converting the unconsolidated zone into a consolidated zone, while the expandable fluid can be allowed to expand and flow through the unconsolidated zone, thereby maintaining permeability of the zone.

The unconsolidated zone subjected to treatment can be any unconsolidated zone or at least partially unconsolidated zone having a low average unconfined compressive strength, as determined by ASTM method number D2166-00e1. Generally, the unconsolidated zone can have an average unconfined compressive strength of less than about 20 pounds per square inch (psi), less than about 10 psi, or less than 7 psi.

The unconsolidated zone subjected to treatment can also be any unconsolidated zone or at least partially unconsolidated zone having a permeability sufficient to allow subterranean fluids to flow through the unconsolidated zone and into the above-mentioned wellbore. Generally, the unconsolidated zone can have an average permeability of at least about 10 milliDarcies, at least about 100 milliDarcies, or at least 1,000 milliDarcies (i.e., 1 Darcie). Specific examples of unconsolidated zones include, but are not limited to, a subterranean formation, a portion of a subterranean formation, a gravel pack, or a portion of a gravel pack. Furthermore, the unconsolidated zone may comprise a plurality of solid particles, such as, for example, sand, gravel, proppant previously injected into the unconsolidated zone, and the like.

In one embodiment of the present invention, the unconsolidated zone can be proximate a wellbore. Further, the unconsolidated zone may be located at or near a production formation. As used herein, the term "production formation" is defined as any subterranean formation bearing subterranean fluids. Such subterranean fluids can include, but are not limited to, oil, natural gas, and/or water. Additionally, the unconsolidated zone can be located between a wellbore and a production formation, such that subterranean fluids flow through the unconsolidated zone when traveling from the production formation to the wellbore.

In one embodiment of the present invention, the unconsolidated zone to be treated can be at least about 200 feet below ground level, at least about 500 feet below ground level, or at least 1,000 feet below ground level. Further, there may be a plurality of unconsolidated zones at various depths along the length of the wellbore. When there are a plurality of unconsolidated zones along the length of the wellbore, the well treatment medium may be introduced into each zone simultaneously, individually, or in groups of two or more at the same time.

As mentioned above, the well treatment medium of the present invention can generally comprise an expandable fluid and a bonding agent. The expandable fluid of the well treatment medium can be any fluid that exhibits a desired decrease in density with a corresponding increase in temperature and/or reduction in pressure. In one embodiment, the expandable fluid can be any fluid that has a density at 150° F. and 2,000 pounds per square inch absolute (psia) that is at least about 20 percent less than the density of the fluid at 50° F. and 2,000 psia. Further, the expandable fluid can have a density at 150° F. and 2,000 psia that is at least 40 percent less than the density of the fluid at 50° F. and 2,000 psia. The expandable fluid of the well treatment medium can have a density at a temperature of about −4° F. and a pressure of about 286 psia in the range of from about 50 to about 80 lb/ft$^3$, in the range of from about 60 to about 70 lb/ft$^3$, or in the range of from 63 to 67 lb/ft$^3$. The expandable fluid can be a gas at standard temperature and pressure (STP). As used herein, STP is defined as 32° F. and 14.696 psia. Furthermore, the expandable fluid can have a density at STP in the range of from about 0.02 to about 1.00 lb/ft$^3$, in the range of from about 0.05 to about 0.50 lb/ft$^3$, or in the range of from 0.075 to 0.20 lb/ft$^3$. The expandable fluid can have a density at a temperature of about 150° F. and a pressure of about 2,000 psia in the range of from about 10 to about 80 lb/ft$^3$, in the range of from about 15 to about 50 lb/ft$^3$, or in the range of from 20 to 40 lb/ft$^3$. Specific examples of expandable fluids suitable for use in the present invention include, but are not limited to, propane, butane, and carbon dioxide. In one embodiment, the expandable fluid can be carbon dioxide.

In one embodiment of the present invention, the expandable fluid can be present in the well treatment medium in an amount such that the weight of the expandable fluid accounts for at least about 10 percent of the total weight of the well treatment medium. Further, the weight percent of the expandable fluid based on the total weight of the well treatment medium can be in the range of from about 15 to about 75 weight percent, or in the range of from 20 to 50 weight percent.

The bonding agent of the well treatment medium may comprise any material that acts to bond at least a portion of the solid particles in an unconsolidated zone together, in order to convert at least a portion of an unconsolidated zone to a consolidated zone. Such materials may include, but are not limited to, cement or epoxy resins. According to one embodiment of the present invention, the bonding agent comprises cement. A variety of cements can be utilized in accordance with the present invention, including those comprised of calcium, aluminum, silicon, oxygen and/or sulfur which set and harden by reaction with water. Such cements include Portland cements, pozzolana cements, gypsum cements, aluminous cements, silica cements, alkaline cements and slag cements. The cements can be standard cements of conventional particle sizes (i.e., particle sizes in the range of from about 10 microns to about 20 microns) or of fine cements having particle sizes in the range of from about 2 microns to about 5 microns, or mixtures thereof. The cement according to the present invention may comprise Portland cements of the types defined and described in *API Specification for Materials and Testing for Well Cements,* American Petroleum Institute Specification 10, 5$^{th}$ ed., Jul. 1, 1990. Additionally, in one embodiment, the cement may comprise a low density or light cement. Examples of suitable commercially available low density cements include, but are not limited to, Halliburton LIGHT cement, available from Halliburton, and LITECRETE, available from Schlumberger.

In one embodiment, the bonding agent can be present in the well treatment medium in an amount such that the weight of the bonding agent accounts for at least about 10 percent of the total weight of the well treatment medium. Further, the weight percent of the bonding agent based on the total weight of the well treatment medium can be in the range of from about 15 to about 75 weight percent, or in the range of from 20 to 50 weight percent.

The subterranean zones penetrated by wellbores which may be treated using the well treatment medium of this invention generally have temperatures in the range of from about 100° F. to about 500° F. and pressures in the range of from about 1,000 psia to about 25,000 psia. In one embodiment of the present invention, the bonding agent readily cures at these temperatures and pressures, as well as at higher temperatures and pressures.

The well treatment medium of the present invention can also comprise water. The water in the well treatment medium can be fresh water or salt water. The term "salt water" as used herein is defined as unsaturated salt solutions and saturated salt solutions including brine and seawater. When water is present in the treatment medium, the expandable fluid-to-water weight ratio of the treatment medium can be greater than about 0.25:1, in the range of from about 0.5:1 to about 10:1, or in the range of from 0.75:1 to 5:1.

The well treatment medium of the present invention may also comprise any additives known or used in the industry including, but not limited to, dispersing agents, ID retarding agents, accelerators, and/or fluid loss control agents. Additionally, the treatment medium of the present invention may also comprise an aggregate. Aggregates that can be used in the present invention may comprise sand, gravel, bauxite, sintered bauxite, ceramic materials, glass beads, foamed ceramics, nut shells, coke, polymer beads, glass materials, and the like. In one embodiment of the present invention, the amount of additives employed in the treatment medium may be minimized. In such an embodiment, the bonding agent, expandable fluid and water can account for at least about 50 weight percent, at least about 70 weight percent, at least about 90 weight percent, or at least 95 weight percent of the treatment medium based on the total weight of the well treatment medium.

In one embodiment of the present invention, the well treatment medium can comprise a fluid portion and a solid particle portion. In such an embodiment, the solid particle portion can comprise the bonding agent, and the fluid portion can comprise the expandable fluid. The fluid portion and solid particle portion can be present in the well treatment medium in any amounts resulting in the treatment medium having a viscosity sufficient to allow the treatment medium to flow or be pumped down a wellbore. The treatment medium may comprise a weight ratio of the fluid portion to the solid particle portion in the range of from about 0.5:1 to about 20:1, in the range of from about 0.75:1 to about 10:1, or in the range of from 1:1 to 8:1. In another embodiment, the expandable fluid to solid particle portion weight ratio can be greater than about 0.25:1, in the range of from about 0.5:1 to about 10:1, or in the range of from 0.75:1 to 5:1. Typically, the fluid portion will be in a liquid state when introduced into the wellbore, such that the treatment medium is in the form of a slurry.

As mentioned above, the well treatment medium can be pumped or allowed to flow down a wellbore to the desired depth. The wellbore can be of any variety used in the industry, including, but not limited to, a substantially vertical wellbore or a wellbore that has been directionally drilled in any angle from substantially vertical to substantially horizontal. Furthermore, the wellbore can be uncompleted, cased-hole completed, or open-hole completed at the time the present invention is employed. As used herein, the term "cased-hole completed" is defined as a method of completing a wellbore, wherein the casing of the wellbore extends substantially to the bottom of the wellbore. As used herein the term "open-hole completed" is defined as a method of completing a wellbore wherein the casing does not extend substantially to the bottom of the wellbore.

Additionally, the wellbore can comprise a casing. As used herein, the term "casing" is defined as a pipe of any material that is smaller in diameter than the diameter of the uncased wellbore, and is bonded at least in part to the earthen walls of the wellbore. Any method known in the art may be employed to bond the casing to the earthen walls of the wellbore. Furthermore, the wellbore may comprise tubing. As used herein, "tubing" is defined as a pipe of any material that is smaller in diameter than the optional casing employed in the wellbore.

In one embodiment of the present invention, the well treatment medium can be introduced into the top of the wellbore and is pumped or allowed to flow down the wellbore. The conditions (i.e., temperature and pressure) at the top of the wellbore can be sufficient to maintain the expandable fluid as a dense liquid and/or supercritical fluid. Furthermore, the wellbore can have conditions such that the expandable fluid substantially remains in a dense liquid and/or supercritical state while being pumped or flowing down the wellbore.

In one embodiment, introducing the treatment medium into an unconsolidated zone (e.g., unconsolidated subterranean formation and/or gravel pack) may be accomplished by pumping or flowing the medium through tubing in place inside the wellbore. In this embodiment, the treatment medium can be pumped or allowed to flow down the tubing positioned within a slotted, perforated, and/or screened well casing which extends into the well. The annulus between the tubing and the slotted, perforated, and/or screened casing can be temporarily blocked using packers positioned above and below the slotted, perforated, and/or screened portion of the casing. With the packers in place, the treatment medium flowing out of the end of the tubing will be forced to flow upward into the annulus existing on the outside of the casing. When the treatment medium is in place across the slotted, perforated, and/or screened section of the casing, the pumping or flowing operation can be discontinued and the bonding agent can be allowed to cure.

In one embodiment, the treatment medium may be transported to the unconsolidated zone by pumping or flowing the medium down the annulus created between the tubing and the optional casing. In another embodiment, the treatment medium may be transported to the unconsolidated zone by pumping or flowing the medium down the inner walls of the casing. In either of these two embodiments, the casing can be slotted, perforated, and/or screened at or near the unconsolidated zone. Packers can be initially set above and below the slotted, perforated, and/or screened intervals to prevent the well treatment medium from passing into the non-isolated portions of the well and also to permit build-up of sufficient pressures on the treatment medium. Such pressures can operate to force the treatment medium through the perforations, slots and/or screen and into the unconsolidated zone.

As mentioned above, upon introduction of the well treatment medium into the unconsolidated zone, the bonding agent may be allowed to cure while the expandable fluid expands. In one embodiment, the curing of the bonding agent and the expansion of the expandable fluid may occur substantially simultaneously. Furthermore, the expandable fluid can be allowed to expand from a first density to a second density, wherein the second density is at least about 10 percent less than the first density, at least about 20 percent less than the first density, or at least 40 percent less than the first density.

In one embodiment, while the bonding agent at least partially cures, the expandable fluid may be allowed to move through the unconsolidated zone, thereby creating flow passages through the unconsolidated zone. According to one embodiment of the present invention, at least a portion of the flow passages created by the passage of the expandable fluid can remain after the expandable fluid has departed from the unconsolidated zone and the unconsolidated zone has been converted to a consolidated zone.

As mentioned above, the bonding agent may be allowed to cure in the unconsolidated zone. In one embodiment of the present invention, after curing, at least a portion of the bonding agent can remain in the unconsolidated zone. The curing of the bonding agent can enhance the bonding of the solid particles of the unconsolidated zone together, thereby converting at least a portion of the unconsolidated zone to a consolidated zone.

The consolidated zone of the present invention can have any permeability sufficient to allow subterranean fluids to flow through the consolidated zone and into the wellbore. Further, the consolidated zone can have an average permeability of at least about 10 percent, at least about 50 percent, or at least 75 percent of the permeability of the unconsolidated zone. Additionally, the average permeability of the consolidated zone can be greater than about 1 milliDarcy, greater than about 10 milliDarcies, or greater than 100 milliDarcies.

The average unconfined compressive strength of the consolidated zone, as determined by ASTM method number D2166-00e1, may be at least about 25 percent greater, at least about 75 percent greater, or at least 150 percent greater than the average unconfined compressive strength of the unconsolidated zone. Further, the average unconfined compressive strength of the consolidated zone can be at least about 25 psi, in the range of from about 30 to about 5,000 psi, in the range of from about 65 to about 2,500 psi, or in the range of from 100 to 1,000 psi.

After at least a portion of the unconsolidated zone has been converted into a consolidated zone, substantially all of the expandable fluid can be removed from the consolidated zone. Thereafter, a subterranean fluid originating from the subterranean formation may be caused to flow through the consolidated zone and into the wellbore, allowing for retrieval of the subterranean fluids. Such subterranean fluids can comprise oil, natural gas, and/or water.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

DEFINITIONS

As used herein, the terms "comprising," "comprises," and "comprise" are open-ended transition terms used to transition from a subject recited before the term to one or more elements recited after the term, where the element or elements listed after the transition term are not necessarily the only elements that make up of the subject.

As used herein, the terms "including," "includes," and "include" have the same open-ended meaning as "comprising," "comprises," and "comprise."

As used herein, the terms "having," "has," and "have" have the same open-ended meaning as "comprising," "comprises," and "comprise."

As used herein, the terms "containing," "contains," and "contain" have the same open-ended meaning as "comprising," "comprises," and "comprise."

As used herein, the terms "a," "an," "the," and "said" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

What is claimed is:

1. A method of treating an unconsolidated zone proximate to a wellbore that is at least 500 feet below ground level so that at least a portion of the unconsolidated zone is converted to a consolidated zone having sufficient porosity to allow subterranean fluids to flow therethrough, wherein the method comprising:

(a) flowing a well treatment medium downwardly through a wellbore to a desired depth of at least 500 feet below ground level, wherein the well treatment medium comprises a bonding agent wherein the bonding agent accounts for at least about ten percent of the total weight of the well treatment fluid and the well treatment medium further comprises an expandable fluid wherein the expandable fluid accounts for at least about ten percent of the total weight of the well treatment fluid, wherein the expandable fluid has a first density at the desired depth;

(b) expanding the expandable fluid to a second density at the desired depth, wherein the second density is at least about 10 percent less than said first density; and wherein the expanding of expandable fluid converts at least a portion of the expandable fluid from a liquid and/or supercritical state to a gaseous state; and (c) curing the bonding agent wherein the expandable fluid is allowed to move through the unconsolidated zone creating flow passages through the unconsolidated zone that remain after the bonding agent has hardened and the expandable fluid has departed from the unconsolidated zone and the unconsolidated zone has been converted to a consolidated zone.

2. The method of claim 1, wherein said expandable fluid is a gas at standard temperature and pressure.

3. The method of claim 1, wherein prior to said expanding of step (b), at least a portion of said expandable fluid is present at said desired depth in a liquid and/or supercritical state.

4. The method of claim 1, wherein said second density is at least about 20 percent less than said first density.

5. The method of claim 1, wherein said expandable fluid comprises propane, butane, and/or carbon dioxide.

6. The method of claim 1, wherein said expandable fluid comprises carbon dioxide.

7. The method of claim 1, wherein said bonding agent comprises cement.

8. The method of claim 1, wherein said treatment medium further comprises water.

9. The method of claim 8, wherein said bonding agent, said expandable fluid, and said water account for at least about 75 percent of the total weight of said treatment medium.

10. The method of claim 1, wherein said treatment medium has an expandable fluid to bonding agent weight ratio of at least about 0.25:1.

11. The method of claim 1, wherein said flowing of step (a) includes introducing said treatment medium into said wellbore proximate the top of said wellbore.

12. The method of claim 11, wherein said treatment medium comprises a solid particle portion and a fluid portion, wherein said solid particle portion comprises said bonding agent, wherein said fluid portion comprises said expandable fluid, wherein said treatment medium has a fluid to solid weight ratio in the range of from about 0.5:1 to about 20:1.

13. The method of claim 12, wherein said fluid portion is in the liquid state when introduced into said wellbore.

14. The method of claim 12, wherein said fluid portion further comprises water, wherein said fluid portion has an expandable fluid to water weight ratio greater than about 0.25:1.

15. The method of claim 1, wherein said expanding of step (b) is at least partly caused by warming said expandable fluid at said desired depth.

16. The method of claim 1, wherein said expanding of step (b) is at least partly caused by reducing the pressure of said expandable fluid at said desired depth.

17. The method of claim 1, further comprising causing said treatment medium to flow into an unconsolidated zone at said desired depth, wherein said unconsolidated zone comprises a plurality of solid particles.

18. The method of claim 17, wherein said expanding of step (b) causes at least a portion of said expandable fluid to move through said unconsolidated zone.

19. The method of claim 18, wherein after said expanding of step (b), at least a portion of said bonding agent remains in said unconsolidated zone and enhances the bonding of said solid particles to one another, thereby converting said unconsolidated zone to a consolidated zone.

20. The method of claim 19, wherein said consolidated zone has an average compressive strength that is at least about 25 percent greater than the average compressive strength of said unconsolidated zone.

21. The method of claim 20, wherein the average compressive strength of said unconsolidated zone is less than about 20 psi.

22. The method of claim 19, wherein said consolidated zone has an average permeability that is at least about 10 percent of the average permeability of said unconsolidated zone.

23. The method of claim 22, wherein the average permeability of said unconsolidated zone is at least about 10 milli-Darcies.

24. The method of claim 19, further comprising removing substantially all of said expandable fluid from said consolidated zone.

25. The method of claim 19, further comprising the step of causing a subterranean fluid to flow through said consolidated zone and into said wellbore after the curing of the bonding agent and the unconsolidated zone has been converted to a consolidated zone.

26. The method of claim 25, wherein said subterranean fluid comprises oil, natural gas, and/or water.

27. The method of claim 18, wherein said unconsolidated zone includes at least a portion of a gravel pack.

28. The method of claim 1, wherein said consolidated zone after the step of curing the bonding agent has an average permeability that is at least about 10 percent of the average permeability of said unconsolidated zone.

29. The method of claim 1, wherein said consolidated zone after the step of curing the bonding agent has an average compressive strength that is at least about 25 percent greater than the average compressive strength of said unconsolidated zone.

30. The method medium of claim 1, wherein said treatment medium has a fluid to solid weight ratio in the range of from about 0.5:1 to about 20:1.

31. The method medium of claim 1, wherein said treatment medium further comprises an aggregate selected from sand and/or gravel.

* * * * *